US009676203B2

(12) United States Patent
Ishida

(10) Patent No.: US 9,676,203 B2
(45) Date of Patent: Jun. 13, 2017

(54) PRINTING APPARATUS, CONTROL DEVICE, AND IMAGE PROCESSING METHOD

(71) Applicant: SEIKO EPSON CORPORATION, Tokyo (JP)

(72) Inventor: Takuya Ishida, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/842,980

(22) Filed: Sep. 2, 2015

(65) Prior Publication Data

US 2016/0089882 A1 Mar. 31, 2016

(30) Foreign Application Priority Data

Sep. 30, 2014 (JP) ..... 2014-201570

(51) Int. Cl.
*B41J 2/21* (2006.01)

(52) U.S. Cl.
CPC ..... *B41J 2/2146* (2013.01); *B41J 2/2139* (2013.01)

(58) Field of Classification Search
CPC ..... B41J 2/2139
See application file for complete search history.

(56) References Cited

U.S. PATENT DOCUMENTS 6,793,319 B2 9/2004 Ikemoto et al.
2002/0159091 A1* 10/2002 Sakura ..... G06F 3/1208 358/1.15
2005/0007404 A1* 1/2005 Usui ..... B41J 2/2052 347/14
2007/0153302 A1* 7/2007 Lin ..... H05K 3/125 358/1.4
2009/0015615 A1* 1/2009 Miyamoto ..... B41J 29/393 347/14
2012/0075370 A1* 3/2012 Ramakrishnan ..... B41J 2/04508 347/10
2015/0070428 A1* 3/2015 Sudo ..... B41J 2/04593 347/14

FOREIGN PATENT DOCUMENTS

JP 2002-103597 A 4/2002
JP 2008-246942 A 10/2008
JP 2008-250435 A 10/2008
JP 2008-250799 A 10/2008

* cited by examiner

*Primary Examiner* — Shelby Fidler
(74) *Attorney, Agent, or Firm* — Global IP Counselors, LLP

(57) ABSTRACT

Image data which defines an ink amount to be ejected from each of a plurality of nozzles is stored in memory, the image data which is stored in the memory is subjected to an interpolation process corresponding to a faulty nozzle of a print head, the image data which is subjected to the interpolation process is subjected to a rotation process and the image data which defines the ink amount to be ejected and corresponds to each of the plurality of nozzles to be stored in the memory so as to be in a read-out order of the memory when the print head is positioned at a certain point in relation to the print medium, and the image data which is subjected to the rotation process is read out and output as the print data.

4 Claims, 14 Drawing Sheets

<INCLINED HEAD>

FIG. 11A INPUT IMAGE
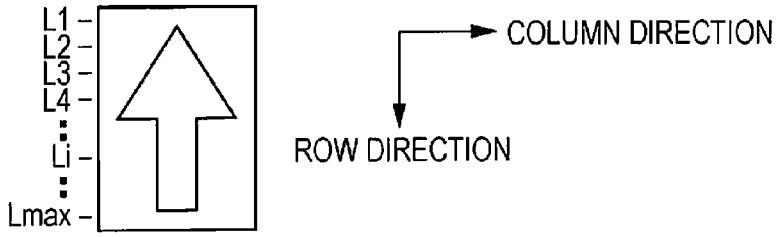
FIG. 11B INCLINATION PROCESS (PRIMARY TRANSFORMATION PROCESS)
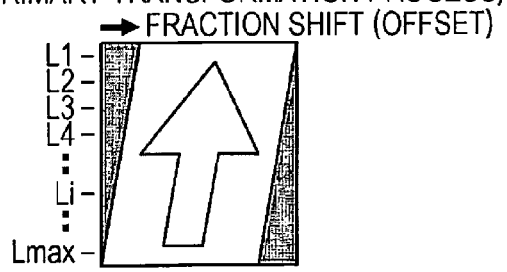
FIG. 11C ROTATION PROCESS (SECONDARY TRANSFORMATION PROCESS)
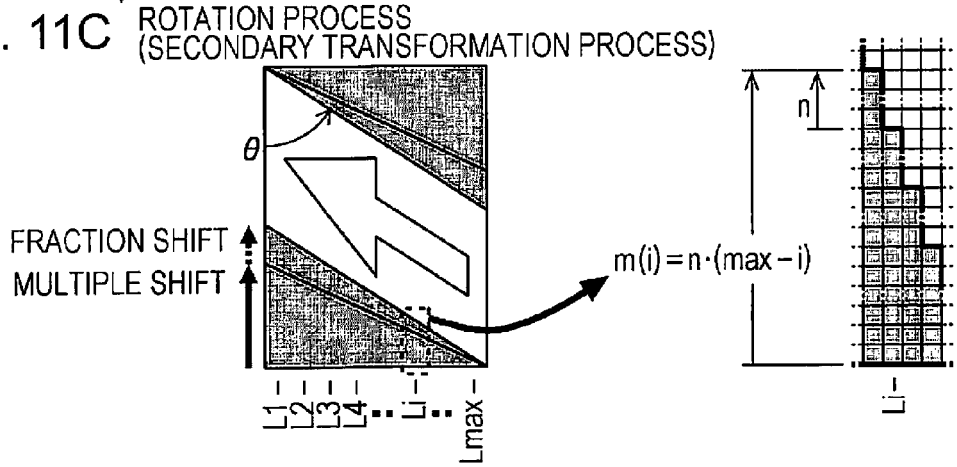
FIG. 11D READOUT AND TRANSFER
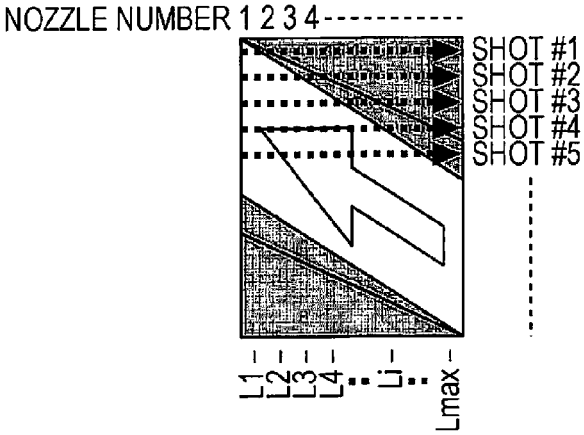

FIG. 13A BEFORE SHIFT
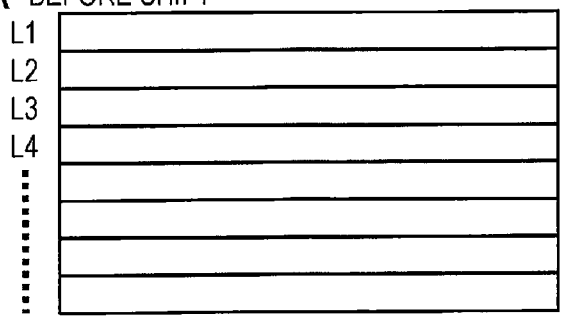
FIG. 13B FRACTION SHIFT
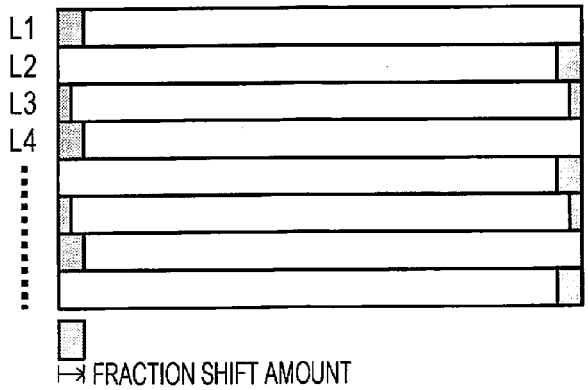
FIG. 13C ROTATION
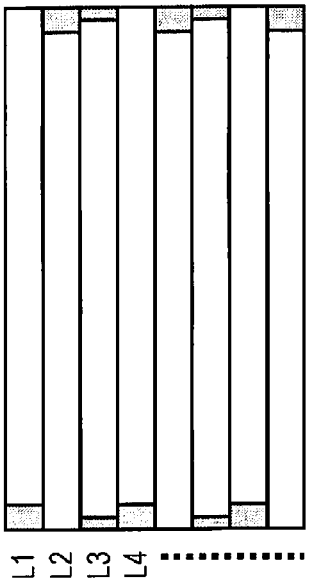
FIG. 13D MULTIPLIER SHIFT
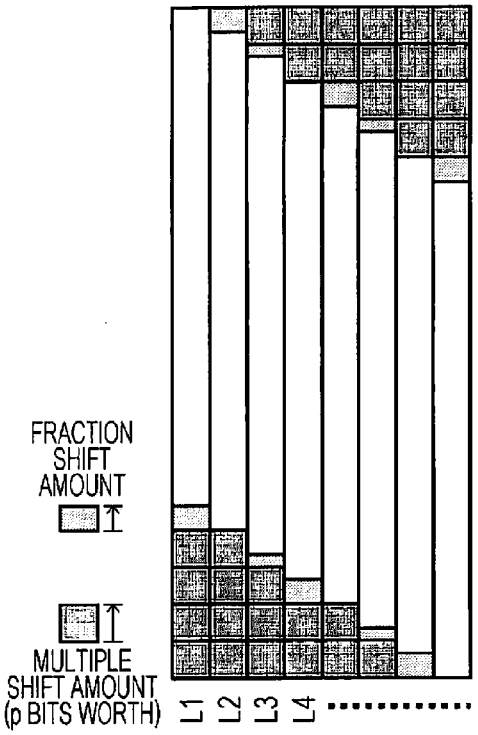

FIG. 14A
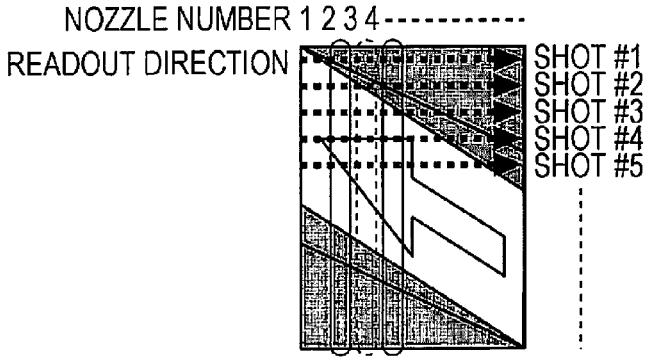
FAULTY NOZZLE POSITION
FIG. 14B DESIRED PRINTED OBJECT
FIG. 14C ACTUAL PRINTED OBJECT (NOT INTERPOLATED)
FIG. 14D ACTUAL PRINTED OBJECT (POST-INTERPOLATION)
FIG. 15A READOUT
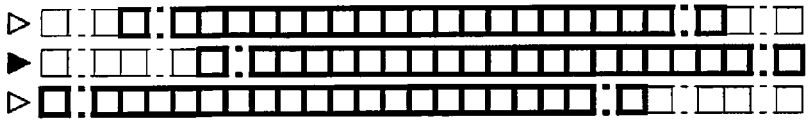
FIG. 15B SHIFT AND INTERPOLATION
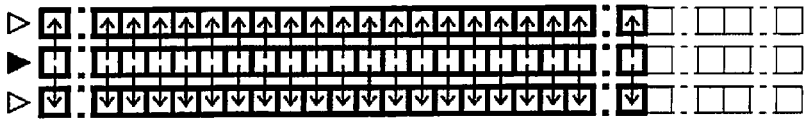
FIG. 15C RE-SHIFT AND WRITEBACK
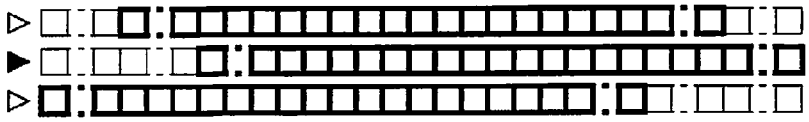
▶ INTERPOLATION TARGET RASTER
▷ RASTER USED IN INTERPOLATION

INPUT IMAGE

INCLINATION PROCESS
(PRIMARY TRANSFORMATION PROCESS)

ROTATION PROCESS
(SECONDARY TRANSFORMATION PROCESS)

STORAGE STATE

PRINTING APPARATUS, CONTROL DEVICE, AND IMAGE PROCESSING METHOD

CROSS REFERENCES TO RELATED APPLICATIONS

The entire disclosure of Japanese Patent Application No. 2014-201570, filed Sep. 30, 2014 is incorporated by reference herein.

BACKGROUND

1. Technical Field

The present invention relates to a printing apparatus, a control device of the printing apparatus, and an image processing method.

2. Related Art

As printing apparatuses which print images and documents by ejecting a liquid such as an ink, printing apparatuses are known which use piezoelectric elements (for example, a piezo element), heating elements, or the like. The piezoelectric elements, the heating elements, or the like are provided to correspond to each of a plurality of nozzles in a print head, and due to being driven according to a drive signal, dots are formed by the piezoelectric elements, the heating elements, or the like causing a predetermined amount of the ink to be ejected from the nozzles at a predetermined timing.

The following technologies are known as technologies to which such a printing apparatus is applied. Examples of the known technology include technology in which, in a configuration in which print source data is extracted, processed into print data, and it is possible to select whether to output the print data as a PRN file, when the processing may not be ordinarily finished, the generated PRN file is deleted (for example, refer to JP-A-2008-250435), technology in which a printing process of a case in which a print command is performed during timer cleaning and a printing process during ordinary times are executed in approximately the same processing time (for example, refer to JP-A-2008-246942), and technology which is configured such that white lines do not emerge in a main scanning direction of a printing result (for example, refer to JP-A-2008-250799).

Incidentally, technology is known in which, in the printing apparatus, for example, a nozzle row of the print head is arranged diagonally in relation to an orthogonal direction of a transport direction of a print medium (refer to JP-A-2002-103597).

In the configuration in which the nozzle row is arranged diagonally in this manner, the load of the image processing of the printing apparatus is exceedingly great in comparison to a configuration in which the nozzle row is arranged in the orthogonal direction of the transport direction, and problems such as the incidence of a reduction in printing speed are anticipated.

SUMMARY

An advantage of some aspects of the invention is that the problems of a case in which the nozzle row of the print head is arranged diagonally in relation to the orthogonal direction of the transport direction of the print medium are solved.

According to an aspect of the invention, there is provided a printing apparatus which causes a print medium to move in a predetermined direction relative to a print head which includes a plurality of nozzles, and causes ink to be ejected from each of the plurality of nozzles based on print data, including: a first processing unit which causes image data of each pixel to be stored in memory; a second processing unit which subjects image data which is stored by the first processing unit to an interpolation process corresponding to a faulty nozzle of the print head; and a third processing unit which subjects the image data which is subjected to the interpolation process to a rotation process and causes the image data which corresponds to each of the plurality of nozzles to be stored in the memory so as to be in a read-out order of the memory when the print head is positioned at a certain point in relation to the print medium, in which the printing apparatus reads out the image data which is stored by the third processing unit and outputs the image data as the print data.

According to the printing apparatus according to the aspect described above, it is possible to execute an interpolation process in a state in which the direction of a faulty image formed due to a faulty nozzle matches the read-out direction of the memory. Therefore, in comparison to a case in which the interpolation process is executed after the rotation process, address calculation in relation to memory is simplified, and it is possible to reduce the time necessary for the processing. In this aspect, since image data which is stored by a third processing unit is read out and output as the print data, it is possible to apply to a case in which the nozzle row of the print head is arranged diagonally in relation to the orthogonal direction of the transport direction of the print medium.

In the printing apparatus according to the aspect of the invention, the memory may be capable of burst transfer, the first processing unit and the third processing unit may store the image data using the burst transfer, and the second processing unit may execute the interpolation process using the image data which is read out from the memory using the burst transfer. In this case, since the image data is stored in or read from the memory using burst transfer, it is possible to reduce the time necessary for the processing.

In the printing apparatus according to the aspect of the invention, information defining at least the faulty nozzle may be supplied to the second processing unit. In this case, it is possible to reflect changes to the interpolation process right away based on information which defines the faulty nozzle.

In the printing apparatus according to the aspect of the invention, the second processing unit preferably executes the interpolation process using at least the image data of two rows which interpose a column corresponding to a position of the faulty nozzle.

Note that, the invention can be realized using various aspects. For example, the invention can be conceptualized by a control device of a printing apparatus, an image processing method, or the like.

BRIEF DESCRIPTION OF THE DRAWINGS

The invention will be described with reference to the accompanying drawings, wherein like numbers reference like elements.

FIG. 8 is a diagram illustrating the waveforms of control signals, drive signals, and the like.

FIGS. 11A to 11D are diagrams illustrating an outline of the processes performed by the control section.

FIGS. 13A to 13D are diagrams for illustrating an array transformation process.

FIGS. 14A to 14D are diagrams for illustrating an interpolation process.

FIGS. 15A to 15C are diagrams for illustrating the interpolation process.

DESCRIPTION OF EXEMPLARY EMBODIMENTS

Hereinafter, description will be given of the embodiments of the invention with reference to the drawings.

Figure 1:
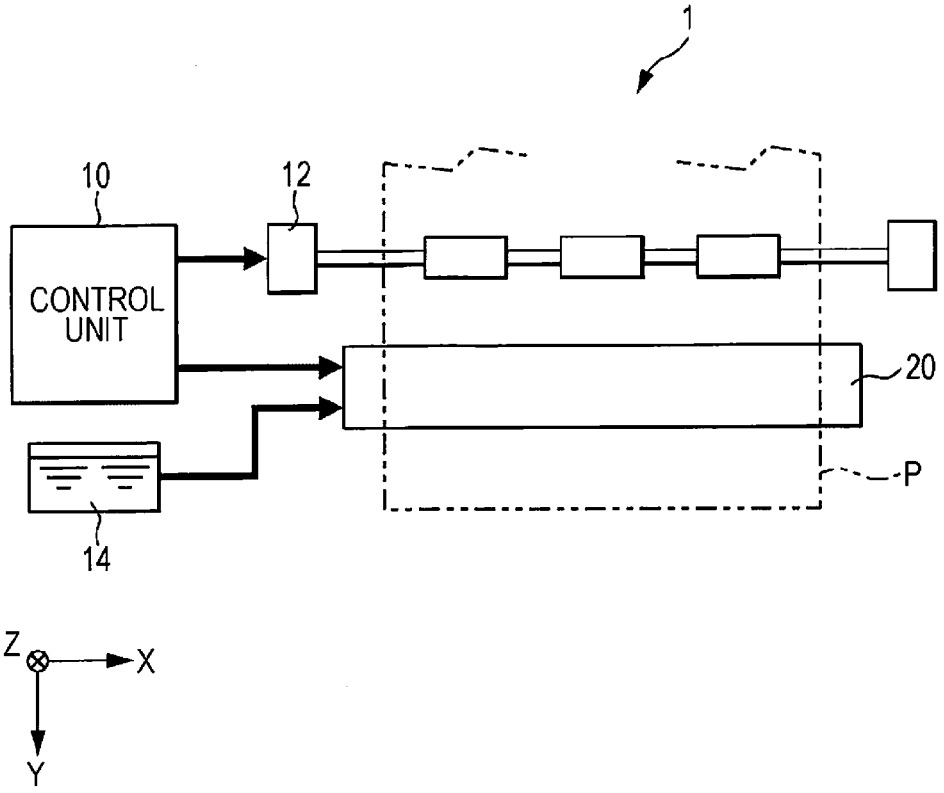
FIG. 1 is a diagram illustrating the schematic configuration of a printing apparatus according to an embodiment.

FIG. 1 is a diagram illustrating the partial configuration of a printing apparatus 1 according to the embodiment.

The printing apparatus 1 is a printing apparatus (ink jet printer) which forms an ink dot group on a print medium P such as paper by ejecting an ink (a liquid), and therefore, an image (including characters, images, and the like) is printed according to the image data.

As illustrated in FIG. 1, the printing apparatus 1 includes a control unit 10, a transport mechanism 12, and a liquid ejecting module 20. A liquid container (a cartridge) 14 which stores a plurality of colors of ink is mounted in the printing apparatus 1. In this example, cyan (C), magenta (M), yellow (Y), and black (Bk), a total of four, colors of ink are stored in the liquid container 14.

As described later, the Control unit 10 processes images which are supplied from an external host computer, controls the elements of the printing apparatus 1, and the like. The transport mechanism 12 transports the print medium P in a Y direction under the control of the control unit 10. The liquid ejecting module 20 ejects the ink which is stored in the liquid container 14 onto the print medium P under the control of the control unit 10. In the embodiment, the liquid ejecting module 20 is a line head which is long in an X direction which intersects (typically, orthogonally intersects) the Y direction.

In the printing apparatus 1, an image is formed on the surface of the print medium P due to the liquid ejecting module 20 ejecting the ink onto the print medium P synchronously with the transporting of the print medium P carried out by the transport mechanism 12.

Note that, a direction which is perpendicular to an X-Y plane (a plane which is parallel to the surface of the print medium P) will be referred to as a Z direction. The Z direction is typically a direction in which the ink is ejected by the liquid ejecting module 20.

Figure 2:
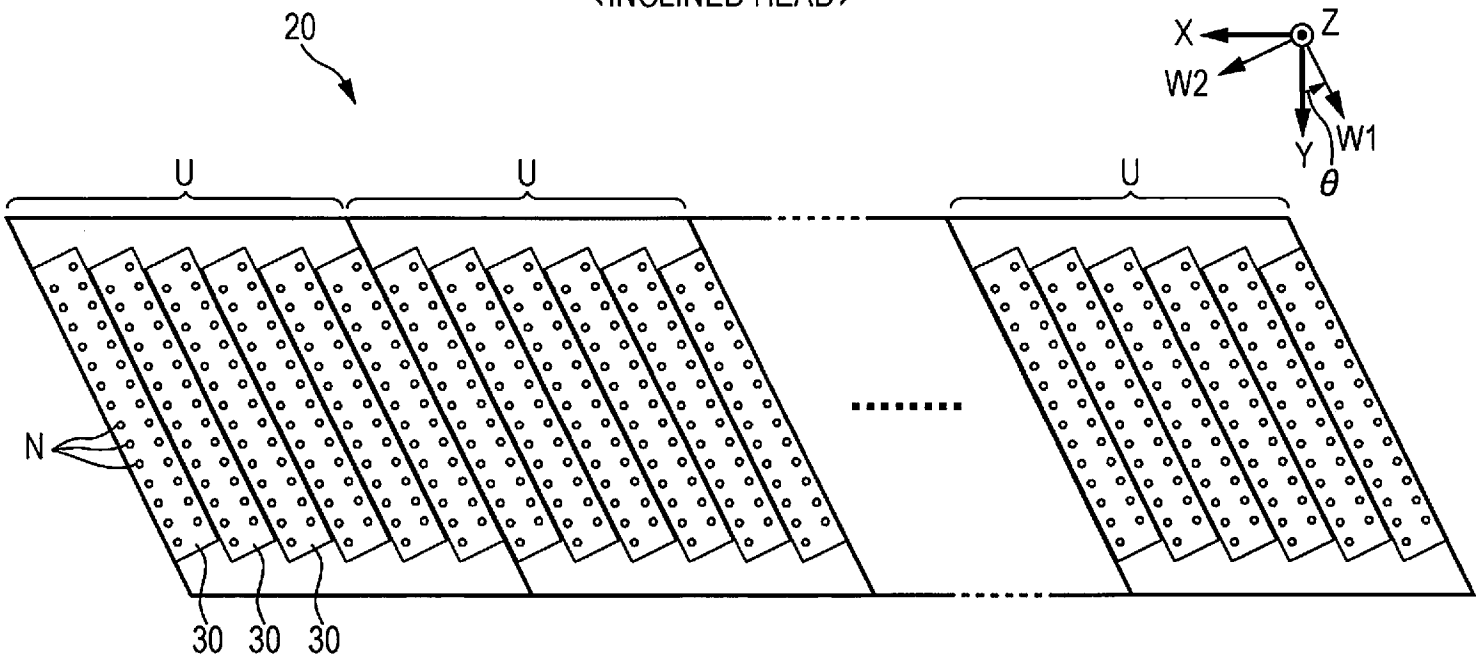
FIG. 2 is a plan view of a liquid ejecting module in the printing apparatus.

FIG. 2 is a plan view of the liquid ejecting module 20 as viewed from the print medium P.

As illustrated in FIG. 2, in the liquid ejecting module 20, a configuration is adopted in which a plurality of liquid ejecting units U, each of which serves as a basic unit, are arranged along the X direction.

The liquid ejecting unit U contains a plurality of (6) liquid ejecting heads 30 which are further arranged along the X direction. The liquid ejecting head 30 (described in detail later) is a print head which includes a plurality of nozzles N which are arranged in two rows which are inclined in relation to the Y direction, which is the transport direction of the print medium P.

Figure 3:
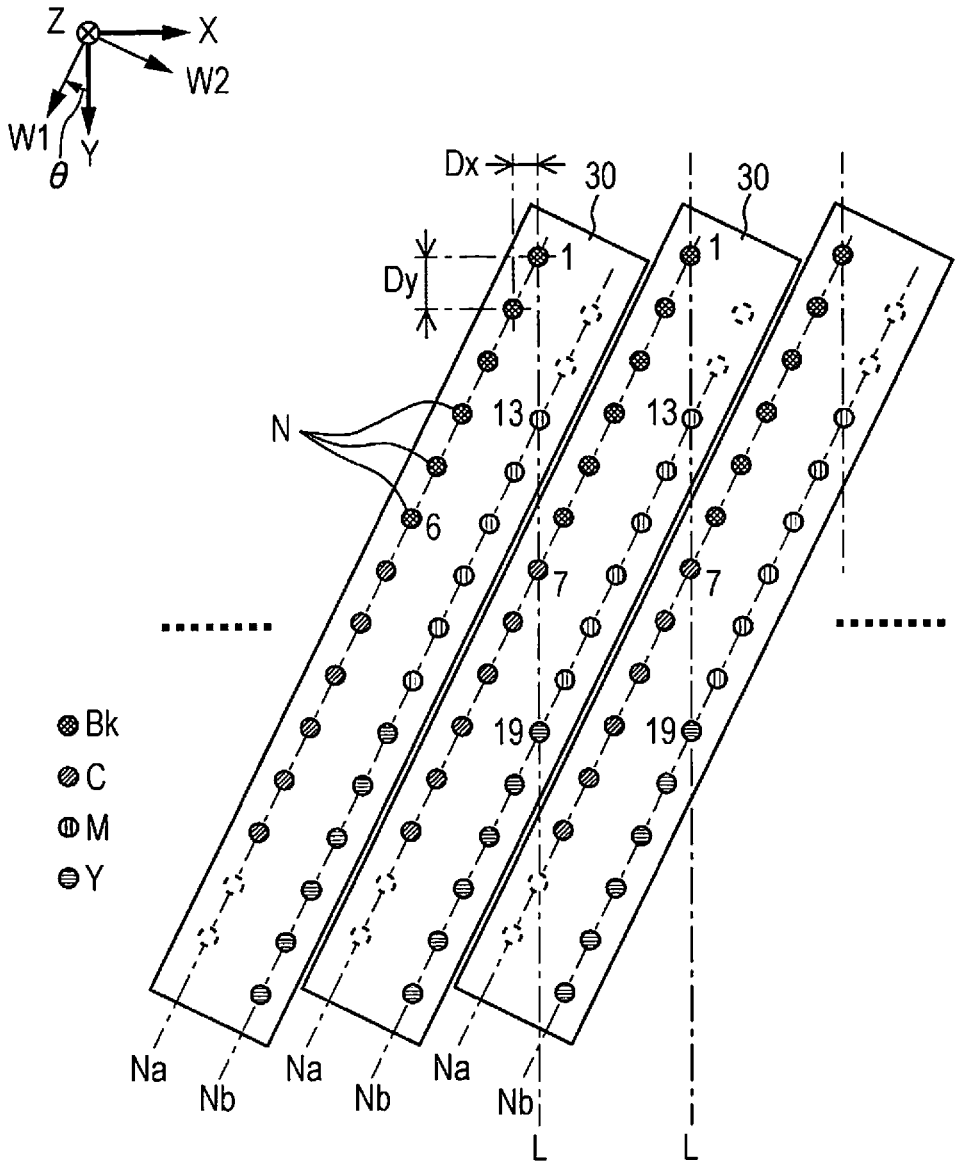
FIG. 3 is a diagram illustrating the arrangement of nozzles in a liquid ejecting head.

FIG. 3 is a diagram for illustrating the arrangement of the nozzles N in the liquid ejecting module 20, and, unlike FIG. 2, is a diagram of a perspective from the opposite side of the print medium P toward the direction in which the ink is ejected.

As described above, one of the liquid ejecting heads 30 includes a plurality of the nozzles N in two inclined rows; however, first, description will be given of the simple nozzle arrangement in the liquid ejecting head 30 without considering the inclination.

Figure 4:
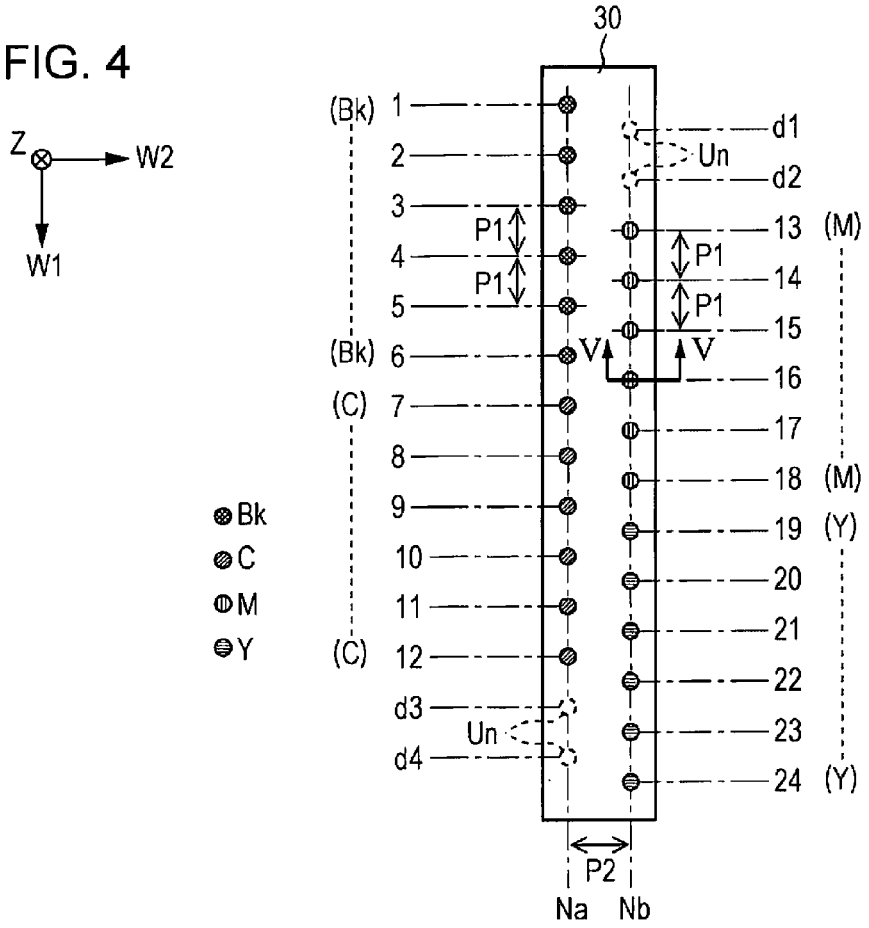
FIG. 4 is a diagram illustrating the arrangement of the nozzles in the liquid ejecting head.

FIG. 4 is a diagram illustrating the arrangement of the nozzles N in the liquid ejecting head 30. As illustrated in FIG. 4, the nozzles N of the liquid ejecting head 30 are divided into nozzle rows Na and Nb. In each of the nozzle row Na and Nb, a plurality of the nozzles N is arranged at a pitch P1 along a W1 direction (a second direction): The nozzle row Na is separated from the nozzle row Nb by the pitch P2 in a W2 direction which orthogonally intersects the W1 direction. The nozzles N belonging to the nozzle row Na and the nozzles N belonging to the nozzle row Nb are in a relationship of being shifted from each other in the W1 direction by half of the pitch P1.

Portions at which the nozzles N are sealed (or, portions which are not open) with circles (reference sign Un) which are illustrated using broken lines at a positive side end portion in the W1 direction (the bottom end in FIG. 4) in the nozzle row Na, and circles (also reference sign Un) which are illustrated using broken lines at a negative side end portion in the W1 direction (the top end in FIG. 4). In other words, the circles which are illustrated using the broken lines virtually illustrate the positions at which the nozzles N would be provided as opening portions if, hypothetically, the positions were not sealed. This is a measure taken in order to facilitate the explanation of the arrangement of the nozzles N.

Note that, in FIGS. 3 and 4, in order to facilitate the explanation, the number of the nozzles N in each of the nozzle rows Na and Nb is set to "12", and the number of virtual nozzles Un in each of the nozzle rows Na and Nb is set to "2"; however, in actuality, the number of the nozzles N in a nozzle row is "480" (for one row), for example, and the number of the virtual nozzles Un is "10" (also for one row).

In FIG. 4, nozzle numbers for identifying the nozzles N and the like hereinafter are illustrated. In this example, for the nozzle row Na, the consecutive numbers 1, 2, . . . , 11, 12 are given as the nozzle numbers in order from the nozzle N positioned at the negative side end portion in the W1 direction. For the nozzle row Nb, the consecutive numbers 13, 14, . . . , 23, 24 are given as the nozzle numbers in order from the nozzle N positioned at the negative side end portion in the W1 direction.

Note that, the numbers d3 and d4 are given to the virtual nozzles Un in the nozzle row Na as the nozzle numbers from the negative side in the W1 direction, and the numbers d1 and d2 are given to the virtual nozzles Un in the nozzle row Nb as the nozzle numbers from the negative side in the W1 direction.

The correspondence with the colors of the ink which is ejected from the nozzles N is also illustrated in FIG. 4. In this example, the nozzles N from the nozzle number "1" to "6" correspond to black (Bk), the nozzles N from the nozzle number "7" to "12" correspond to cyan (C), the nozzles N from the nozzle number "13" to "18" correspond to magenta (M), and the nozzles N from the nozzle number "19" to "24" correspond to yellow (Y).

As illustrated in FIG. 3, the liquid ejecting heads 30 which include the plurality of the nozzles N are arranged to be inclined at an angle θ which is neither orthogonal nor parallel in relation to the Y direction, which is the transport direction of the print medium P. At this time, in the example of FIG. 3, the nozzles N belonging to the nozzle row Na and the nozzles N belonging to the nozzle row Nb have a common position (coordinate) in the X direction.

Specifically, focusing on one of the liquid ejecting heads 30, the angle θ is set such that a virtual line L which extends in a direction parallel to the Y direction, which is the transport direction of the print medium P, passes through one of the nozzles N (the nozzle N with the nozzle number "1") which is positioned on the negative side end portion in the W1 direction in the nozzle row Na in the liquid ejecting head 30 being focused on, and one of the nozzles N (the nozzle N with the nozzle number "13") which is positioned on the negative side end portion in the W1 direction in the nozzle row Nb.

The adjacent liquid ejecting head 30 has the following positional relationship with the liquid ejecting head 30 being focused on. In other words, in the liquid ejecting head 30 which is positioned on the right side of the liquid ejecting head 30 being focused on in FIG. 3, the nozzle N with the nozzle number "7" and the nozzle N with the nozzle number "19" are in a positional relationship in which the virtual line L passes therethrough.

Therefore, when the print medium P is transported in the Y direction, the black (Bk) ink which is ejected from the nozzle N with the nozzle number "1", the magenta (M) ink which is ejected from the nozzle N with the nozzle number "13" in a certain liquid ejecting head 30, the cyan (C) ink which is ejected from the nozzle N with the nozzle number "7", and the yellow (Y) ink which is ejected from the nozzle N with the nozzle number "19" in the liquid ejecting head 30 which is positioned on the left side of the aforementioned liquid ejecting head 30 are caused to land in the same position, and therefore, it is possible to form a color dot.

In FIG. 3, although the nozzle numbers other than "1", "6", "7", "13", and "19" are omitted, the nozzles N with the nozzle numbers "2" and "14" in the liquid ejecting head 30 being focused on, and the nozzles N with the nozzle numbers "8" and "20" in the liquid ejecting head 30 on the left side of the liquid ejecting head 30 being focused on have a common position in the X direction. The correspondence of the other nozzle numbers will be omitted; however the correspondence is the same.

Figure 5:
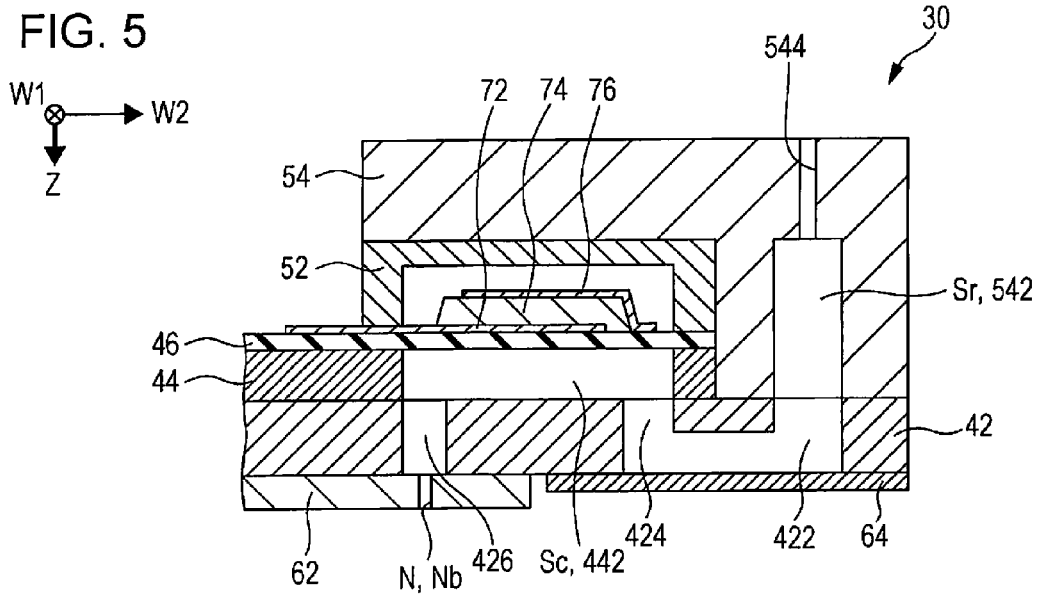
FIG. 5 is a sectional view of a portion of the liquid ejecting head.

FIG. 5 is a sectional view illustrating the structure of one of the nozzles N of the liquid ejecting head 30. Specifically, FIG. 5 is a diagram illustrating the section taken across the V-V line in FIG. 4 (a section perpendicular to the W1 direction, as viewed from the negative side in the W1 direction toward the positive side direction).

As illustrated in FIG. 5, the liquid ejecting head 30 is a structure (a head chip) in which a pressure chamber substrate 44, a diaphragm 46, a sealing body 52, and a support body 54 are provided on the surface of the negative side in the Z direction of a flow path substrate 42, and a nozzle plate 62 and a compliance portion 64 are installed on the surface of the positive side in the Z direction of the flow path substrate 42. The elements of the liquid ejecting head 30 are members which, as described above, are schematically long in the W1 direction and are substantially flat plate shaped, and, for example, are fixed to each other using an adhesive. The flow path substrate 42 and the pressure chamber substrate 44 are formed of a silicon single crystal substrate, for example.

The nozzles N are formed in the nozzle plate 62. As schematically illustrated in FIG. 4, in the liquid ejecting head 30, the structure corresponding to the nozzles N belonging to the nozzle row Na and the structure corresponding to the nozzles N belonging to the nozzle row Nb are in a relationship of being shifted from each other in the W1 direction by half of the pitch P1. However, since, other than this shifting, the structures are formed substantially symmetrically, hereinafter the structure of the liquid ejecting head 30 will be described with a focus on the nozzle row Nb.

The flow path substrate 42 is a flat plate member which forms the flow path of the ink, and an opening portion 422, a supply flow path 424, and a communicating flow path 426 are formed in the flow path substrate 42. The supply flow path 424 and the communicating flow path 426 are formed for each of the nozzles N, and the opening portion 422 is formed to continue across a plurality of the nozzles N which eject the same color of ink.

The support body 54 is fixed to the surface of the negative side in the Z direction of the flow path substrate 42. A storage portion 542 and an inlet flow path 544 are formed in the support body 54. The storage portion 542 is a concave portion (a depression) with an external shape which corresponds to the opening portion 422 of the flow path substrate 42 as viewed in plan (that is, the Z direction), and the inlet flow path 544 is a flow path which communicates with the storage portion 542.

A space which communicates the opening portion 422 of the flow path substrate 42 with the storage portion 542 of the support body 54 functions as a liquid storage chamber (a reservoir) Sr. The liquid storage chamber Sr is formed independently for each of the colors of ink, and stores the ink which passes through the liquid container 14 (refer to FIG. 1) and the inlet flow path 544. In other words, four of the liquid storage chambers Sr are formed in the inner portion of one of the liquid ejecting heads 30 to correspond to the different inks.

An element which forms the bottom surface of the liquid storage chamber Sr and suppresses (absorbs) pressure fluctuation in the ink in the liquid storage chamber Sr and the inner portion flow path is the compliance portion 64. The compliance portion 64 is configured to include a flexible member which is formed in a sheet shape, for example. Specifically, the compliance portion 64 is fixed to the surface of the flow path substrate 42 such that the opening portion 422 and the supply flow paths 424 in the flow path substrate 42 are blocked.

The diaphragm 46 is installed in the pressure chamber substrate 44 on the surface of the opposite side from the flow path substrate 42. The diaphragm 46 is a flat plate shaped member capable of elastically vibrating, and is formed by laminating an elastic film which is formed of an elastic material such as silicon oxide, and an insulating film which is formed of an insulating material such as zirconium oxide, for example. The diaphragm 46 and the flow path substrate 42 face each other on the inside of each opening portion 442 of the pressure chamber substrate 44 with an interval therebetween. The space which is interposed by the flow path substrate 42 and the diaphragm 46 on the inside of each of the opening portions 442 functions as a pressure chamber Sc which applies a pressure to the ink. Each of the pressure chambers Sc communicates with the nozzle N via the communicating flow path 426 of the flow path substrate 42.

A piezoelectric element Pzt corresponding to the nozzle N (the pressure chamber Sc) is formed for each of the nozzles N on the surface of the diaphragm 46 of the opposite side from the pressure chamber substrate 44.

The piezoelectric element Pzt includes a drive electrode 72, a piezoelectric body 74, and a drive electrode 76. The drive electrode 72 is formed on the surface of the diaphragm 46 individually for each of the piezoelectric elements Pzt, the piezoelectric body 74 is formed on the surface of the drive electrode 72, and the drive electrode 76 is formed on the surface of the piezoelectric body 74. Note that, the region in which the drive electrodes 72 and 76 face each other to interpose the piezoelectric body 74 functions as the piezoelectric element Pzt.

The piezoelectric body 74 is formed in a process including heat treatment (baking), for example. Specifically, the piezoelectric body 74 is formed by baking a piezoelectric material which is applied to the surface of the diaphragm 46 on which a plurality of the drive electrodes 72 is formed using heat treatment in a baking furnace, and subsequently forming (for example, milling in which a plasma is used) the piezoelectric body 74 for each of the piezoelectric elements Pzt.

A portion of the drive electrode 72 is configured to be exposed from the sealing body 52 and the support body 54, a wiring substrate (not shown) is connected to this exposed portion, and voltage Vout of a drive signal is applied thereto. Meanwhile, in the drive electrode 76, a common fixed voltage (for example, a voltage VBS described later) is applied across a plurality of the piezoelectric elements Pzt. Note that, since the drive electrode 76 is electrically connected in common across a plurality of the piezoelectric elements Pzt, the drive electrodes 76 may adopt a configuration of being formed individually for each of the piezoelectric elements Pzt and connected to a common wiring, and may adopt a configuration of being connected across the plurality of piezoelectric elements Pzt.

In the piezoelectric element Pzt which is configured in this manner, the center portion warps upward or downward in relation to both end portions in relation to the periphery in FIG. 5 together with the drive electrodes 72 and 76 and the diaphragm 46 according to the voltage which is applied by the drive electrodes 72 and 76. Specifically, the configuration of the piezoelectric element Pzt is such that, when the voltage Vout of the drive signal which is applied to the piezoelectric element Pzt via the drive electrode 72 drops, the piezoelectric element Pzt warps upward. Conversely, when the voltage Vout rises, the piezoelectric element Pzt warps downward.

Here, if the piezoelectric element Pzt warps upward, since the volume of the inner portion of the pressure chamber Sc expands, the ink is sucked in from the liquid storage chamber Sr, whereas, if the piezoelectric element Pzt warps downward, since the volume of the inner portion of the pressure chamber Sc shrinks, an ink droplet is ejected from the nozzle N according to the degree of the shrinking.

In this manner, the configuration of the piezoelectric element Pzt is such that when an appropriate drive signal is applied to the piezoelectric element Pzt, the ink which is sucked in from the liquid storage chamber Sr due to the displacement of the piezoelectric element Pzt is ejected from the nozzle N.

As described later, the timing at which the ink is ejected from a plurality (in the example of FIG. 4, 24) of the nozzles N in one of the liquid ejecting heads 30 is common. Therefore, in a configuration in which the nozzle row Na (Nb) is inclined by the angle θ in relation to the Y direction, which is the transport direction, dots are formed on the print medium P which is transported in the Y direction as follows.

Figure 6:
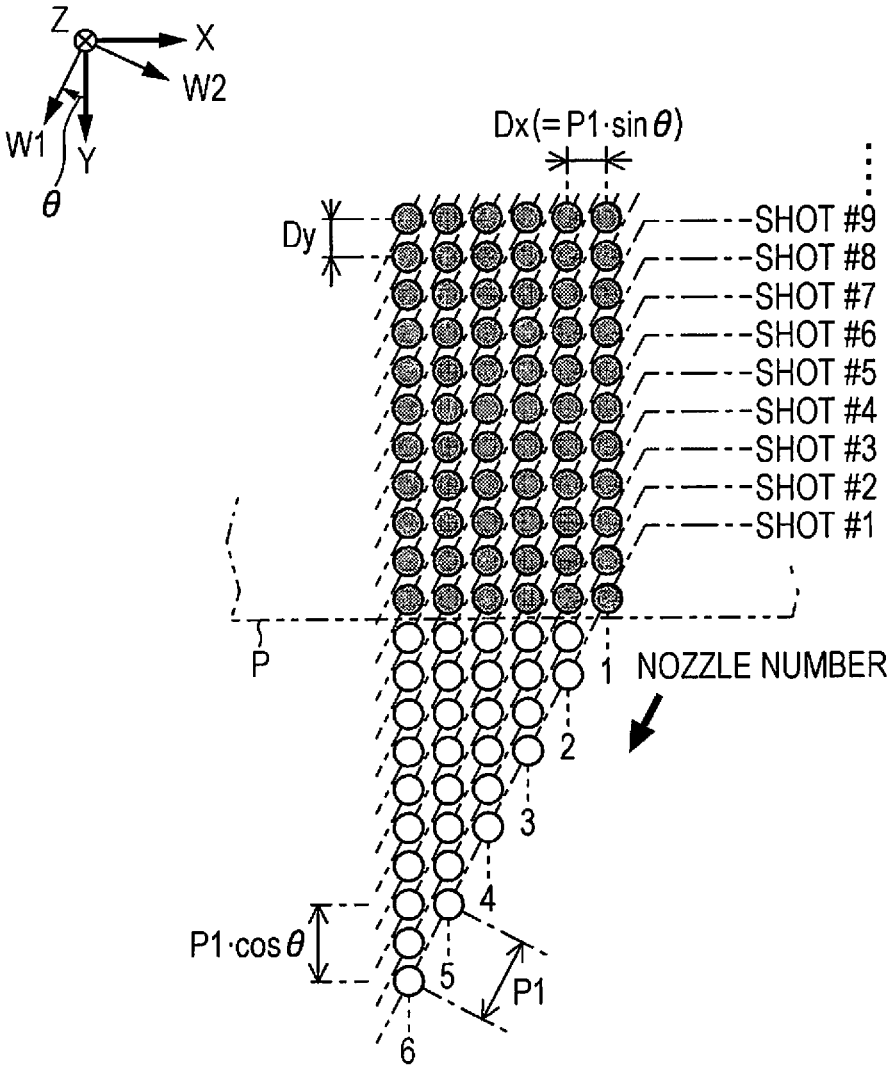
FIG. 6 is an explanatory diagram illustrating dots which are formed by ink ejection of the liquid ejecting head.

FIG. 6 is a diagram focusing on the nozzles N with the nozzle numbers "1" to "6" in the liquid ejecting head 30, illustrating the dots which are formed by the ink which is ejected from the nozzles N.

As illustrated in FIG. 6, each time the print medium P is transported by a pitch Dy in the Y direction, the black (Bk) ink is ejected from the nozzles N with the nozzle numbers "1" to "6" at once at a timing of shot #1, #2, #3, . . . . A dot pitch Dx of the dots in the X direction (that is, a direction orthogonally intersecting the transport direction of the print medium P) is represented by P1·sin θ. Here, as described above, P1 is the arrangement pitch of the nozzles N along the W1 direction.

Note that, in FIG. 6, to facilitate explanation, a configuration is adopted as an example in which, when the print medium P is transported by the pitch Dy, the ink is ejected once from the nozzle N to form a dot; however, as described later, there is also a configuration in which the ink is ejected from the nozzle N two or more times in order to express gradation.

Incidentally, the plurality of nozzles N are not in a state in which it is always possible to eject the ink (ordinary nozzle), and, for example, there is a case in which a state is assumed in which the ink may not be ejected due to nozzle clogging or the like (faulty nozzle). When one of the nozzles N becomes a faulty nozzle, processing becomes necessary, such as forming the dot to be formed by the faulty nozzle by interpolation using the dots in the periphery of the dot (typically, adjacent dots).

In general, a bitmap image (an image data IMG) which is input from a host computer or the like, is defined as orthogonal array of pixels (a dot matrix). Meanwhile, in the present embodiment, the image is formed by ejecting the ink from the nozzles N which are arranged inclined in relation to the Y direction by the angle θ at once. Here, when the image data IMG is temporarily stored in the memory (DRAM), as described layer, high speed printing may not be performed unless the orthogonal array is transformed in advance to an array according to the inclination of the nozzles and transferred using burst transfer.

Here, before the interpolation process, the array transformation process, and the like, description will be given of the electrical configuration of the printing apparatus 1, which serves as the premise.

Figure 7:
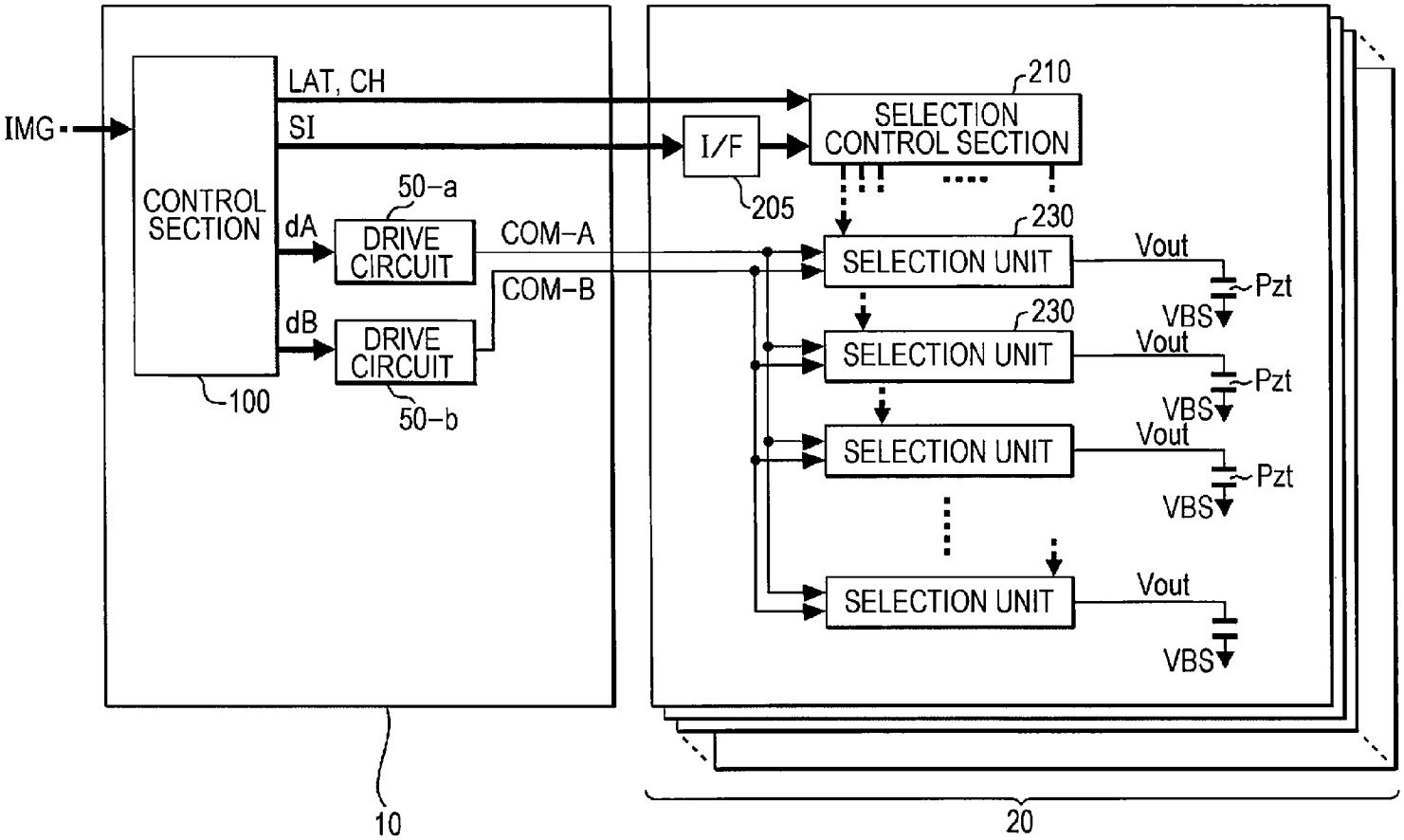
FIG. 7 is a block diagram illustrating an electrical configuration of the printing apparatus.

FIG. 7 is a block diagram illustrating the electrical configuration of the printing apparatus 1.

As illustrated in FIG. 7, the printing apparatus 1 is configured such that the liquid ejecting module 20 is connected to the control unit 10.

The liquid ejecting module 20 is formed of a plurality of the liquid ejecting units U, as described above, and the liquid ejecting unit U contains a plurality (6) of the liquid ejecting heads 30. Here, if the number of the liquid ejecting units U is set to an integer U, the number of the liquid ejecting heads 30 is 6·U.

Although the control unit 10 controls each of the 6·U liquid ejecting heads 30 independently, here, for convenience, description will be given using the control of one of the liquid ejecting heads 30 as representative.

As illustrated in FIG. 7, the control unit 10 includes a control section 100, and drive circuits 50-*a* and 50-*b*.

Of these components, in summary, the control section 100 executes the following processes.

In other words, first, the control section 100 subjects the image data IMG which is supplied from the host computer to image processing such as an interpolation process and an array transformation process by executing a predetermined program, and temporarily stores the image data IMG.

Note that, print data SI is data which defines one dot worth to be formed on the print medium P by the printing apparatus 1.

Second, the control section 100 reads out the print data SI which is temporarily stored, and supplies a clock signal Sck, and control signals LAT and CH to the liquid ejecting head 30 together with the print data SI corresponding to the read-out.

Third, of the drive circuits 50-*a* and 50-*b*, the control section 100 supplies digital data dA to the drive circuit 50-*a*, and supplies digital data dB to the drive circuit 50-*b*. Here, of the drive signals which are supplied to the liquid ejecting head 30, the data dA defines the waveform of a drive signal COM-A, and the data dB defines the waveform of a drive signal COM-B.

Here, the drive circuit 50-*a* subjects the data dA to analogue conversion, subsequently subjects the converted data to class D amplification, and supplies the amplified signal to the liquid ejecting head 30 as the drive signal COM-A. Similarly, the drive circuit 50-*b* subjects the data dB to analogue conversion, subsequently subjects the converted data to class D amplification, and supplies the amplified signal to the liquid ejecting head 30 as the drive signal COM-B. The drive circuits 50-*a* and 50-*b* differ only in the input data and the output drive signals, and have the same circuit configurations.

Note that, in addition, the control section 100 controls the transport mechanism 12 and controls the transporting of the print medium P in the Y direction; however, description of the configuration for carrying out the control will be omitted.

Meanwhile, in addition to the plurality of the piezoelectric elements Pzt described above, one of the liquid ejecting heads 30 electrically includes an interface (I/F) 205, a selection control section 210, and a plurality of selection units 230 which form pairs with each of the piezoelectric elements Pzt. The print data SI is input to the interface (I/F) 205, and the interface 205 supplies the print data SI to the selection control section 210. The selection control section 210 instructs which of the drive signals COM-A and COM-B is to be selected (or to be not selected) for each of the selection units 230 using the control signals or the like supplied from the control section 100, and each of the selection units 230 selects the drive signal COM-A or COM-B according to the instruction of the selection control section 210, and applies the selected drive signal to one end if the piezoelectric element Pzt as a drive signal.

Note that, in FIG. 7, in order to distinguish the voltage of the drive signal which is selected by the selection unit 230 from the drive signals COM-A and COM-B, the voltage of the selected drive signal is represented by Vout.

The voltage VBS is applied in common to the other end of each of the piezoelectric elements Pzt, as described above.

In this example, one dot is expressed in four levels of gradation of a big dog, a medium dot, a small dot, and non-recording by causing the ink to be ejected a maximum of two times from one of the nozzles N. In order to express the four levels of gradation, in this example, two types of the drive signal COM-A and COM-B are prepared, and each of the drive signals COM-A and COM-B holds an early half pattern and a latter half pattern in one period. A configuration is adopted in which, in one period, the drive signal COM-A and COM-B are selected (or not selected) according to the gradation to be expressed in the early half and the latter half, and are supplied to the piezoelectric element Pzt.

Therefore, first, description will be given of the drive signals COM-A and COM-B, and subsequently, description will be given of the manner in which the drive signals COM-A and COM-B are selected according to the print data SI and applied to one end of the piezoelectric element Pzt as the voltage Vout of the drive signal.

Figure 8:
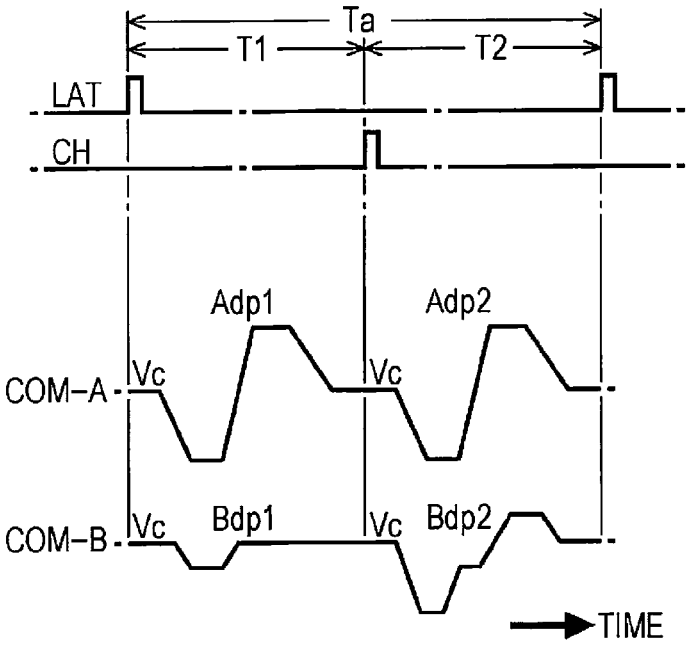

FIG. 8 is a diagram illustrating the waveforms of the drive signals COM-A and COM-B, and the like.

In FIG. 8, Ta is a unit period necessary to form one dot, that is, a period necessary to transport the print medium P by the pitch Py in the Y direction, and is divided into an early half period T1 and a latter half period T2. The early half period T1 is from when the control signal LAP is output (the rise) until the control signal CH is output, and the latter half period T2 is from when the control signal CH is output until the next control signal LAT is output.

The drive signal COM-A is a waveform in which a trapezoidal waveform Adp2 which is disposed in the period T2 continues from a trapezoidal waveform Adp1 which is disposed in the period T1. In this example, the trapezoidal waveforms Adp1 and Adp2 are substantially the same waveform as each other, and the trapezoidal waveforms Adp1 and Adp2 are waveforms which, if hypothetically applied to one end of the piezoelectric element Pzt, cause a predetermined amount, specifically, approximately a medium amount of the ink to be ejected from the nozzle N corresponding to the piezoelectric element Pzt.

The drive signal COM-B is a waveform in which a trapezoidal waveform Bdp2 which is disposed in the period T2 continues from a trapezoidal waveform Bdp1 which is disposed in the period T1. In this example, the trapezoidal waveforms Bdp1 and Bdp2 are waveforms which differ from each other. Of the two, the trapezoidal waveform Bdp1 is a waveform for subjecting the ink in the vicinity of the nozzle N to minute vibrations to prevent an increase in the viscosity of the ink.

Therefore, even if the trapezoidal waveform Bdp1 is hypothetically supplied to one end of the piezoelectric element Pzt, an ink droplet is not ejected from the nozzle N corresponding to the piezoelectric element Pzt. The trapezoidal waveform Bdp2 is a waveform which differs from the trapezoidal waveform Adp1 (Adp2). The trapezoidal waveform Bdp2 is a waveform which, if hypothetically supplied to one end of the piezoelectric element Pzt, will cause a smaller amount of the ink than the predetermined amount to be ejected from the nozzle N corresponding to the piezoelectric element Pzt.

Note that, at the start timing and the end timing of the trapezoidal waveforms Adp1, Adp2, Bdp1, and Bdp2, all of the waveforms have a common voltage Vc. In other words, each of the trapezoidal waveforms Adp1, Adp2, Bdp1, and Bdp2 is a waveform which starts at the common voltage Vc and ends at the common voltage Vc.

The selection control section 210 and the selection unit 230 are configured to select and apply the drive signals COM-A and COM-B to one end of the piezoelectric element Pzt corresponding to the nozzle N according to the print data SI.

As described above, in the liquid ejecting head 30, the ink is ejected from the nozzles N corresponding to the transportation of the print medium P at the timing of shot #1, #2, #3, . . . . Here, when the control section 100 causes the ink to be ejected from a plurality of the nozzles N at a certain shot (there is also a case in which the control section 100 does not cause the ink to be ejected), while the print data SI corresponding to the nozzles N is transferred to the selection control sections 210 before the shot, in the selection control sections 210, the transferred print data SI corresponding to the nozzles N is latched. When the shot is reached, the control section 100 is configured to cause the selection unit 230 corresponding to each of the nozzles N (each of the piezoelectric elements Pzt) to select and apply either the drive signal COM-A or COM-B (or not select either) to one end of the corresponding piezoelectric element Pzt according to the latched print data SI.

Figure 9:
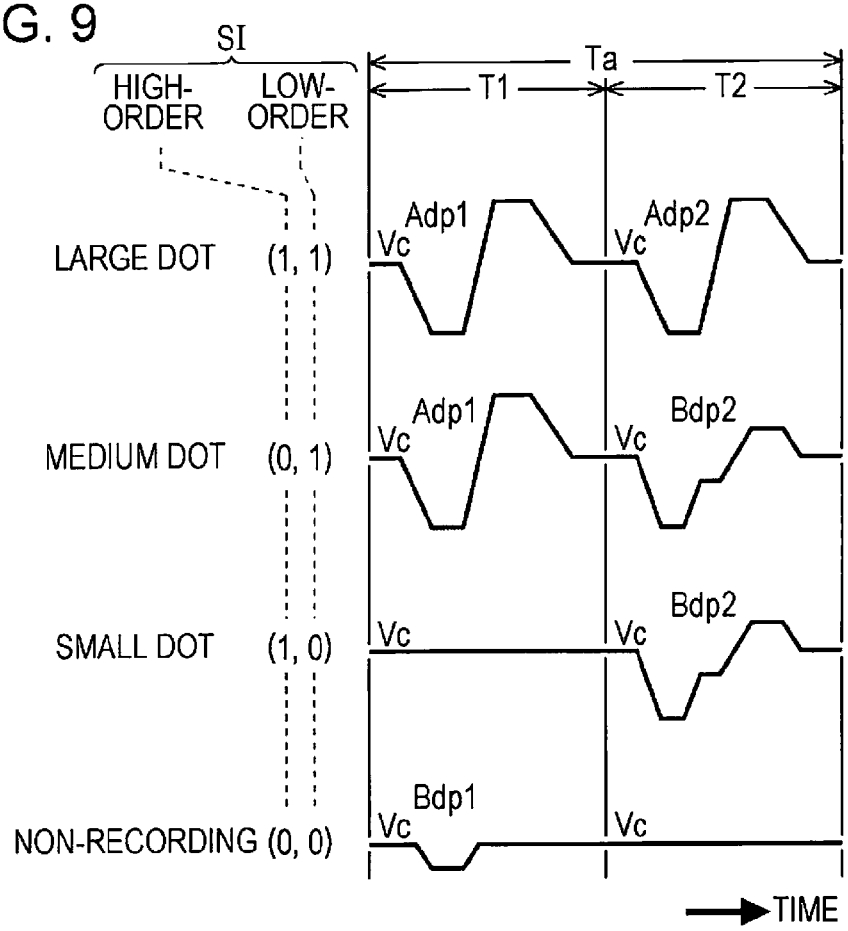
FIG. 9 is a diagram illustrating the waveforms of drive signals which are applied to a piezoelectric element.

FIG. 9 is a diagram illustrating the manner in which the waveform of the voltage Vout of the drive signal is selected in relation to the print data SI corresponding to a certain one of the nozzles N.

As illustrated in FIG. 9, when the print data SI is (1, 1), the trapezoidal waveform Adp1 of the drive signal COM-A is selected in the period T1, and the trapezoidal waveform Adp2 of the drive signal COM-A is selected in the period T2. In this manner, when the trapezoidal waveform Adp1 is selected in the period T1, the trapezoidal waveform Adp2 is selected in the period T2, and the trapezoidal waveforms Adp1 and Adp2 are supplied to one end of the piezoelectric element Pzt as the drive signal, approximately a medium amount of the ink is ejected from the nozzle N corresponding to the piezoelectric element Pzt, separated into two times.

Therefore, each droplet of ink lands on the print medium P to combine with the other droplet, and as a result, the large dot as defined by the print data SI is formed.

When the print data SI is (0, 1), the trapezoidal waveform Adp1 of the drive signal COM-A is selected in the period T1, and the trapezoidal waveform Bdp2 of the drive signal COM-B is selected in the period T2. In this manner, when the trapezoidal waveform Adp1 is selected in the period T1, the trapezoidal waveform Bdp2 is selected in the period T2, and the trapezoidal waveforms Adp1 and Bdp2 are supplied to one end of the piezoelectric element Pzt as the drive signal, approximately a medium amount and approximately a small amount of the ink is ejected from the nozzle N corresponding to the piezoelectric element Pzt, separated into two times.

Therefore, each droplet of ink lands on the print medium P to combine with the other droplet, and as a result, the medium dot as defined by the print data SI is formed.

When the print data SI is (1, 0), neither the trapezoidal waveform Adp1 of the drive signal COM-A nor the trapezoidal waveform Bdp1 of the drive signal COM-B is selected in the period T1. Note that, when the selection unit 230 does not select either the drive signal COM-A or COM-B, the path from the output end of the selection unit 230 to one end of the piezoelectric element Pzt enters a high impedance state in which no portion thereof is electrically connected. However, one end of the piezoelectric element Pzt is held at the voltage Vc directly prior due to the capacitance held by the piezoelectric element Pzt. In this case, the trapezoidal waveform Bdp2 is selected in the period T2, and is supplied to one end of the piezoelectric element Pzt as the drive signal.

Therefore, since approximately a small amount of the ink is ejected from the nozzle N only in the period T2, a small dot as defined in the print data SI is formed on the print medium P.

When the print data SI is (0, 0), the trapezoidal waveform Bdp1 of the drive signal COM-B is selected in the period T1, and neither the trapezoidal waveform Adp2 of the drive signal COM-A nor the trapezoidal waveform Bdp1 of the drive signal COM-B is selected in the period T2.

Therefore, since the ink in the vicinity of the nozzle N is only subjected to minute vibrations in the period T1 and the ink is not ejected, as a result, no dot is formed, that is, "non-recording" as defined in the print data SI.

In this manner, the selection unit 230 selects (or does not select) the drive signal COM-A or COM-B according to the instructions of the selection control section 210, and applies the result to one end of the piezoelectric element Pzt.

Therefore, each of the piezoelectric elements Pzt is driven according to the size of the dot defined in the print data SI.

Note that, the drive signals COM-A and COM-B illustrated in FIG. 8 are only examples. In actuality, various pre-prepared waveforms are combined and used according to the transport speed, the properties, and the like of the print medium P.

Here, although description is given of an example in which the piezoelectric element Pzt warps upward with a drop in the voltage Vout, if the lamination order of the drive electrodes 72 and 76 is reversed, the piezoelectric element Pzt warps upward with a rise in the voltage Vout. In this manner, in a configuration in which the piezoelectric element Pzt warps upward with a rise in the voltage Vout, the drive signals COM-A and COM-B exemplified in FIG. 8 become inverted around the voltage Vc, which is used as a reference.

In this manner, although one dot is formed on the print medium P over the unit period Ta using (a maximum of) two ejections of the ink, as illustrated in FIG. 6, one dot may be formed using one ejection of the ink. Hereinafter, to facilitate explanation, description is given using a configuration in which one dot is formed using one ejection of the ink. Note that, in this configuration, since the print data SI defines the ejection or non-ejection of the ink, the print data SI is one bit. Although not particularly illustrated, in this configuration, as may be inferred from the FIGS. 8 and 9, the drive circuit 50-*b* stops outputting the drive signal COM-B, the drive circuit 50-*a* outputs only one of the trapezoidal waveforms Adp1 in the unit period Ta, and the ink is ejected, or not ejected, from the nozzle N according to the print data SI.

Figure 10:
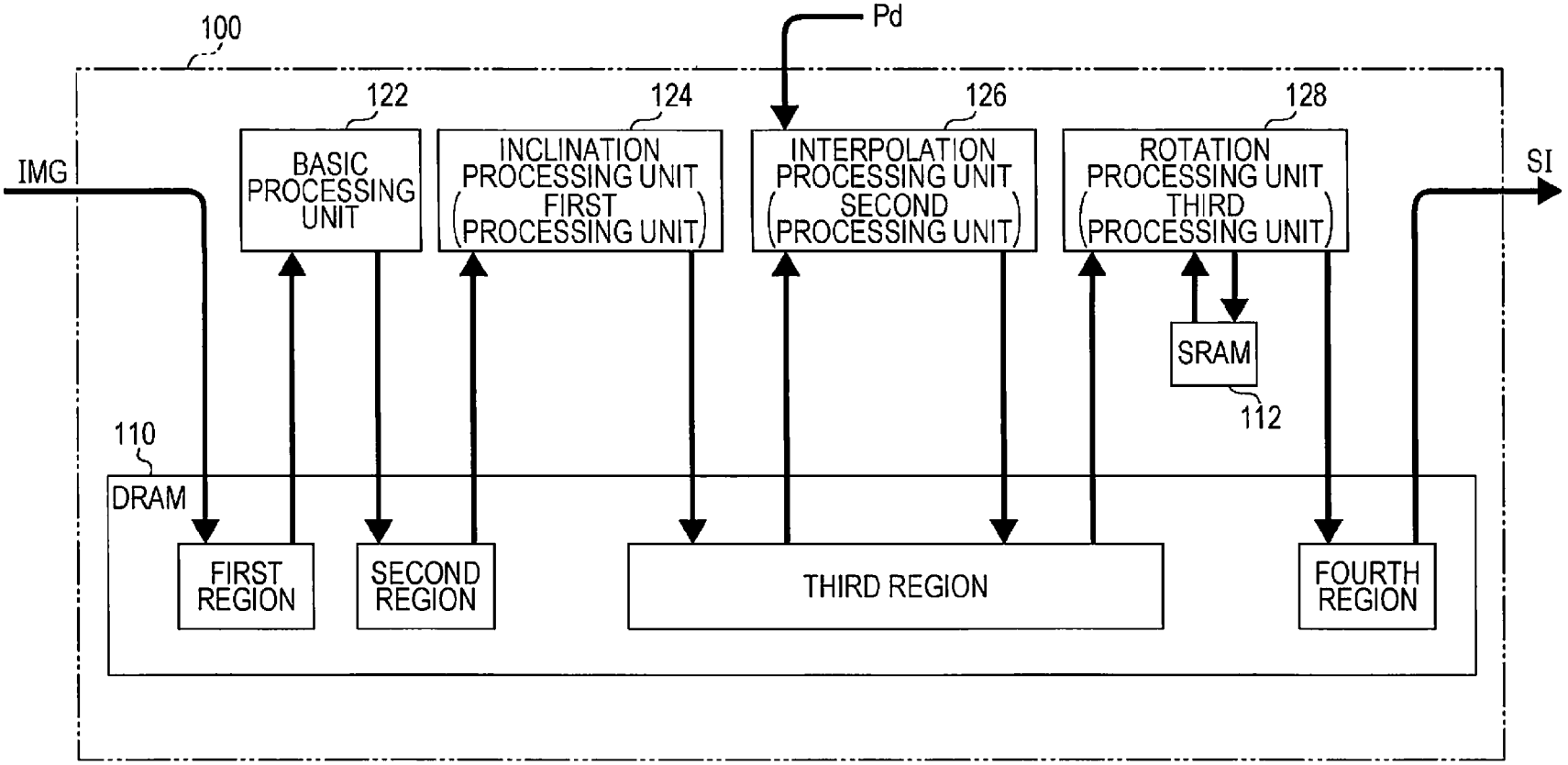
FIG. 10 is a block diagram illustrating the configuration of a control section in the printing apparatus.

FIG. 10 is a block diagram illustrating the configuration of the control section 100. In FIG. 10 illustrates a function of outputting the print data from the supplied image data IMG, and a function of outputting the data dA and dB, the clock signal Sck, and the control signals LAT and CH is omitted.

The control section 100 includes Dynamic Random Access Memory (DRAM) 110, Static Random Access Memory (SRAM) 112, a basic processing unit 122, an inclination processing unit 124, an interpolation processing unit 126, and a rotation processing unit 128. Of these, the DRAM 110 (a first memory) is used as a temporary work memory, and is divided into first to fourth regions for convenience. The SRAM 112 (a second memory) is used as a buffer during memory access, and the storing and read-out thereof are high speed in comparison to the DRAM 110.

To describe the control section 100 in summary, the first region stores the image data IMG which is supplied from the host computer. The basic processing unit 122 subjects the image data IMG which is stored in the first region to individual difference correction in nozzle units, an error diffusion process, or the like. The second region stores the image data which is processed by the basic processing unit 122. In the present embodiment, the array transformation process is divided into two processes, a primary transformation process and a secondary transformation process, for the reasons described later. The inclination processing unit (a first processing unit) 124 subjects the image data which is stored in the second region to the primary transformation process of the array transformation processes. The third region stores the image data which is processed by the inclination processing unit 124. When the interpolation processing unit 126 acquires positional information Pd of faulty nozzles in the liquid ejecting head 30, the interpolation processing unit 126 subjects the image data which is stored in the third region to an interpolation process in which dots which may not be formed by the faulty nozzles are interpolated and formed by the other nozzles, and writes the result back to the third region. The rotation processing unit 128 executes a rotation process in which the image data which is stored in the third region is rotated by 90 degrees, and the secondary transformation process of the array transformation processes. The fourth region stores the image data which is processed by the rotation processing unit 128. The image data which is stored in the fourth region is read out using burst transfer, that is, the data which is stored in consecutive addresses for the nozzles which will eject the ink in one shot is read out, and supplied to the interface 205 in the liquid ejecting head 30 side as the print data SI.

FIGS. 11A to 11D are diagrams illustrating an outline of the array transformation processes executed by the control section 100.

FIG. 11A is a diagram illustrating an example of the image data which is stored in the second region, that is, the image data which is processes by the basic processing unit 122. FIG. 11A illustrates a state in which the image data is stored in the second region sequentially in the horizontal direction in lines L1, L2, L3, . . . . Note that, in the drawings, the term "line L1" illustrates an arbitrary i-th line of the image data which is stored in the second region. When the image is formed from one line to a final max line, "i" is a line number for generally describing a line, and is any integer from 1 to max. With regard to each memory region of the DRAM 110, a rightward direction is set to a column direction, that is, a storing and reading direction, and a downward direction is set to a row direction.

FIG. 11B illustrates a mapping example of the image data which is stored in the third region, that is, the image data which is subjected to the primary transformation process. In the primary transformation process, the lines are shifted in the column direction by an amount determined by the line number, for each line. The amount by which each line is shifted will be described later.

Although the shift amount in the primary transformation process varies linearly from the line L1 to the final line, as described later, in actuality, since the lines are shifted by a fraction which is determined by the line number, the variation is not actually linear.

Here, the term "shift" refers to causing a storage addresses of the data which defines significant pixels in the input pixels to move in the column direction (the line direction), and writing insignificant (NULL) data to the address generated in the movement.

In FIG. 11B, when insignificant data is written to a certain line on the left end side, there are cases in which insignificant data is also written to the right end side. In these cases, in a certain line, the sum of the insignificant data which is written at the left end side and the insignificant data which is written at the right end side is in a relationship of (p−1) across each line as described later.

The image data which is stored in the third region is subjected to the interpolation process by the interpolation processing unit 126, and is written back to the third region. Note that, the interpolation process will be described later.

FIG. 11C illustrates an example of the image data which is stored in the fourth region, that is, the image data which is subjected to the secondary transformation process.

In the secondary transformation process, in this example, the image data which is subjected to the primary transformation process is caused to rotate counterclockwise by 90 degrees, and the lines are additionally shifted in the line direction by a predetermined multiple for each line. Note that, here, since the line direction refers to after the 90 degree rotation, the line direction is the vertical direction (the row direction) in FIG. 11C in terms of the storage region of the memory.

In this example, after the secondary transformation process, finally, the smaller the line number, the more the upward shift amount increases.

Specifically, the total shift amount in a line L1 can be represented using a function m(i), which uses the line number i as a variable, as in the following equation (1).

$$m(i)=n\cdot(\max-i) \tag{1}$$

Here, "n" is the shift amount from the perspective of adjacent lines and is represented by the following equation (2), for example.

$$n=(P1\cdot\cos\theta)/Dy \tag{2}$$

In this equation, P1 is the pitch of the adjacent nozzles N as illustrated in FIGS. 4 and 6, and Dy is the pitch of the print medium P which is transported in the unit period Ta, that is, the pitch in the Y direction of the formed dots. In other words, a shift amount n illustrates how many of the dots, which are formed in the Y direction, worth the distance of the Y direction component of the pitch P1 corresponds to.

Note that, to facilitate description in FIG. 6, an example is given in which the shift amount n is "2"; however, in actuality, the shift amount n is approximately "3" to "6", for example.

FIG. 11D is a diagram illustrating the read-out order of the image data which is stored in the fourth region. Specifically, in the shot order from the top in FIG. 11D, the image data is read out in the column direction, which has consecutive addresses, and is supplied to the interface 205 as the print data SI (burst transfer).

The liquid ejecting head 30 to which the print data SI, which is subjected to array transformation, is supplied ejects the ink from the nozzles N which are arranged non-orthogonally to the Y direction, which is the transport direction of the print medium P, at once according to the print data SI. Accordingly, as a result, the input image is formed on the print medium P.

Next, description will be given of the point in which the array transformation process in the present embodiment is executed, divided into the primary transformation process and the secondary transformation process.

In the present embodiment, since the ink is ejected from the nozzles N according to the nozzle row for each shot, or the like, the input image data is read out after subjecting the image data to a rotation process. The rotation process is typically executed in the following manner.

Figure 12A:
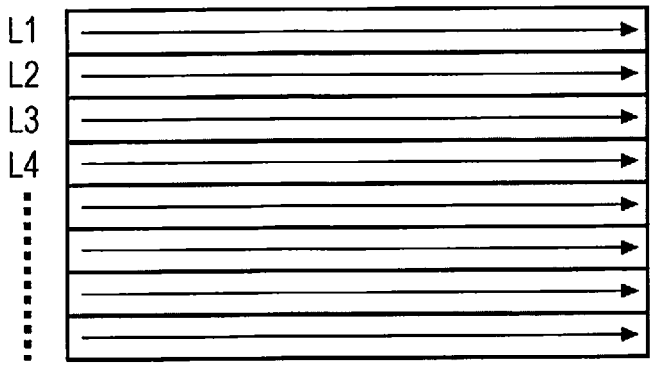
FIGS. 12A to 12C are diagrams for illustrating a typical rotation process.
Figure 12B:
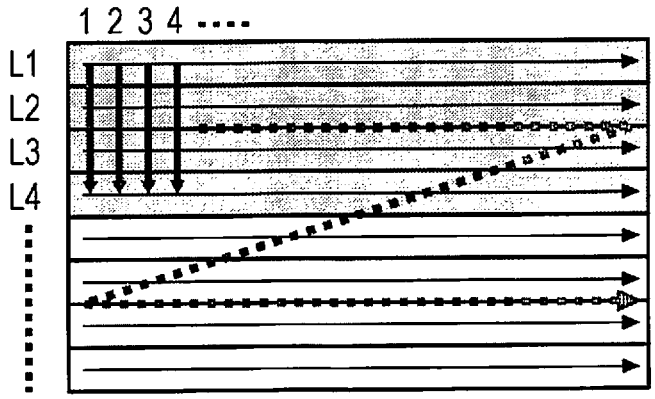
Figure 12C:
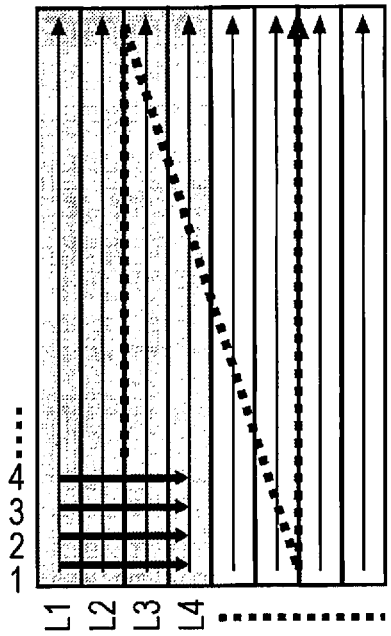

FIGS. 12A to 12C are diagrams for illustrating the rotation process. The rotation process is a re-arranging process in which the image data which is stored as illustrated in FIG. 12A is read out and transferred to the SRAM 112 as the buffer memory as illustrated in FIG. 12B, subsequently, the orthogonal directions are switched with each other and the image data from the SRAM 112 is written back to the DRAM 110, as illustrated in FIG. 12C.

When the data width of the SRAM 112 is p bits, it is possible to comparatively simply and quickly execute a process using p bits as a unit, specifically, a process such as a data insertion (shift) of an integer multiple of the p bits.

As described above, the shift amount of the image data when the image data is stored in the fourth region is represented as in equation (1) for each line; however, when an attempt is made to convert the shift amount in a single process from the image data which is stored in the second region, since the shift amount is not necessarily in an integer multiple relationship with the data width of the SRAM 112, the process becomes inefficient and the shift amount becomes an impediment to high speed processing.

Therefore, in the present embodiment, a configuration is adopted in which, in relation to each line, the integer multiple of the p bits, which is the data width of the SRAM 112, of the total shift amount which is represented by equation (1) is added in the secondary transformation process, and the remainder (the fraction) is added beforehand in the primary transformation process.

Specifically, since the total shift amount to be added to a line with a line number of "i" is indicated in equation (1), while the quotient k and the remainder q when dividing the total shift amount by p are obtained in advance, the line is shifted forward by the remainder q, which is the fraction, in the primary transformation process, and the p bits are shifted by k times, which is the quotient, in the secondary transformation process.

In other words, a configuration is adopted in which, in relation to a line with the line number "i", in the primary transformation process, the line is shifted by the fraction q (a first offset amount), and in the secondary transformation process, the line is shifted by an amount of k times the p bits (a second offset amount).

Incidentally, since the quotient k and the remainder q in the line with the line number "i" are values from when the total shift amount m(i) which is determined by the line number "i" is divided by p, the quotient k and the remainder q can be expressed as (non-linear) functions k(i) and q(i), respectively, using the line number i as a variable. At this time, the total shift amount m(i) is represented by equation (1), and further, since the shift amount n in equation (1) is a function of the angle θ, the fraction q(i), which is the shift amount of the primary transformation process, and the shift amount p·k(i) of the secondary transformation process can be considered to be values corresponding to the angle θ.

Note that, since q is an integer of 0 or greater and less than p, the maximum value is (p−1). In the primary transformation process (refer to FIG. 11B or 13B), as described above, the sum of the insignificant data which is written to the left end side and the insignificant data which is written to the right end side in each line are in a relationship (p−1).

FIGS. 13A to 13D are diagrams for illustrating the content of the array transformation process.

FIG. 13A is the image data which is stored in the second region, which is similar to FIG. 11A. FIG. 13B illustrates a state in which the lines in the image data which is stored in the third region are shifted (fraction shifted) in the column direction for each line by the remainder which is determined by the line number. Note that, the shift amount of a line with a line number "i" is defined by the function q(i).

FIG. 13C is an example in which the image data of FIG. 13B is subjected to the rotation process illustrated in FIGS. 12A to 12C, and FIG. 13D illustrates a state in which the lines in the image data of FIG. 13C which is subjected to the rotation process are shifted (multiple shift) by the multiplier k which is determined by the line number for each line. Note that, since the multiplier of the line with a line number "i" is defined by the function k (i), the shift amount at this time is p·k(i).

According to this array transformation process, since the fraction is added first and the lines are shifted, the lines are subsequently shifted by an integer multiple of the p bits, which is the data width of the SRAM 112, while performing the rotation process using the SRAM 112, it is possible to execute the process simply and quickly in comparison to a case in which both shifts are performed at once.

Note that, in the example of FIGS. 13A to 13D, an example is given in which the secondary transformation process (the multiple shift) is executed after the rotation process; however, a configuration may be adopted in which the secondary transformation process is executed first and the rotation process is executed subsequently.

Next, description will be given of the interpolation process in relation to a faulty nozzle.

FIGS. 14A to 14D are diagrams for illustrating the interpolation process.

As illustrated in FIG. 14A, the image data which is stored in the fourth region is read out in the shot order from the top in FIG. 14A in the column direction in which addresses are consecutive, and is supplied to the interface 205 as the print data SI.

Here, for example, when nozzle clogging occurs in the nozzle N with the nozzle number "3", for example, since the ink is not ejected from the nozzle N, even consecutive dots are to be formed as illustrated in FIG. 14B, a dot is not formed at the position corresponding to the nozzle N, as illustrated in FIG. 14C.

Therefore, for example, as illustrated in FIG. 14D, the dot which may not be formed by the faulty nozzle is interpolated and formed by both of the adjacent dots.

In simple terms, in this interpolation process, the data of a line which serves as the interpolation target and, for example, and the data of a line which is positioned adjacent to the line in order to compensate the line are compared with each other, and if the data of the interpolation target line is "non-recording", the line is ignored; however, if the data of the interpolation target is "recording", the data of the line which is positioned adjacent is replaced with predetermined data.

Here, since the lines in the image data which is stored in the fourth region are not in a state of being stored in consecutive addresses in the column direction in the DRAM 110, burst processing may not be performed when accessing the image data.

Therefore, in the present embodiment, the image data which is subjected to the primary transformation process (the image data in which the line direction of the image matches the column direction of the DRAM 110) in the third region is subjected to the interpolation process.

However, in the image data which is stored in the third region, the lines are shifted by a fraction corresponding to the line number "i" by the primary transformation process. Therefore, the interpolation processing unit 126 executed the interpolation process as illustrated in FIGS. 15A to 15C.

FIGS. 15A to 15C are diagrams for illustrating the content of the interpolation process.

Specifically, first, as illustrated in FIG. 15A, the interpolation processing unit 126 reads out the line corresponding to the positional information Pd of the faulty nozzle and the lines adjacent to the line from the third region using the burst processing. As illustrated in FIGS. 15A to 15C, the start address of the read-out is the left end of each line, specifically, the left end including the insignificant data which is written by the fraction shifting. Accordingly, each line is read out together with the insignificant data which is written by the shifting. Note that, performing the read-out in a state in which the start addresses are shifted is considered not to be preferable since there is a case in which there are restrictions due to the design of the bus which is the path between the DRAM 110 and the interpolation processing unit 126.

Second, as illustrated in FIG. 15B, the interpolation processing unit 126 reverse shifts each line which is read out by the fraction corresponding to the line number. Accordingly, the positions of lines being compared to each other are aligned.

Third, the interpolation processing unit 126 compares the lines, the positions of which are aligned, to each other and executes a substitution process.

Fourth, as illustrated in FIG. 15C, the interpolation processing unit 126 writes the lines which are subjected to the substitution process back to the third region after re-shifting the lines by a fraction corresponding to the line numbers.

According to the interpolation process in the present embodiment, in comparison with a case of processing the image data which is stored in the fourth region, it is possible to obtain a reduction in the processing time and a simplification of the address calculation, since the data of the lines which are stored in consecutive addresses in the DRAM 110 is subjected to burst processing.

Note that, in the primary transformation process, since the shift amount of each of the lines is less than p, which is the data width of the SRAM 112, the time necessary for the shifting and an increase in configuration complexity may be suppressed.

Incidentally, although the piezoelectric element Pzt functions as an actuator which generates a displacement if a voltage change is applied thereto from the outside, conversely, if a displacement is applied thereto, the piezoelectric element Pzt functions as a sensor which outputs a voltage change. Although the details will be omitted, if, hypothetically, nozzle clogging occurs, after the displacement of the piezoelectric element Pzt, since the pressure change in the pressure chamber Sc differs remarkably from ordinary times, it is possible to detect whether the state is ordinary or whether nozzle clogging occurs by providing a detection period after the ink ejection and by determining the voltage change at one end of the piezoelectric element Pzt.

When the positional information Pd of the faulty nozzle which is detected in this manner is supplied to the interpolation processing unit 126, since the information is reflected right away in the interpolation process, the faults of a printed object are corrected in a short period.

Next, description will be given of the handling of a plurality of pages.

As described above, in the present embodiment, the nozzles N are arranged inclined in relation to a direction which orthogonally intersects the transport direction of the print medium P. Therefore, a configuration is adopted in which, as described above, the image data is supplied to the liquid ejecting head 30 as the print data SI after being subjected to an array transformation process using the primary transformation process and the secondary transformation process (including rotation).

However, in such a configuration, when the process is executed repeatedly in page units in relation to the image data of a plurality of pages, overheads in the processes such as the shifting and the rotating increase.

Therefore, in the present embodiment, a configuration is adopted in which, when outputting the image data of a plurality of pages, in summary, the image data of the plurality of pages is subjected to the primary transformation process and the secondary transformation process as the image data of one page, and is divided into page units and output at the stage in which the image data is supplied to the liquid ejecting head 30.

FIGS. 16A to 17D are diagrams for illustrating this process.

Figure 16A:
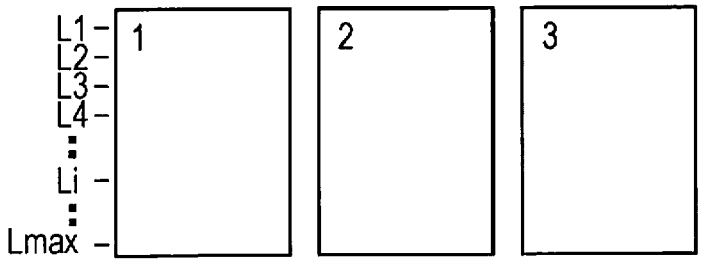
FIGS. 16A and 16B are diagrams for illustrating the processing of a plurality of pages.

FIG. 16A illustrates the image data which serves as the processing target, and in this example, the image data is formed of a first page, a second page, and a third page.

Figure 16B:
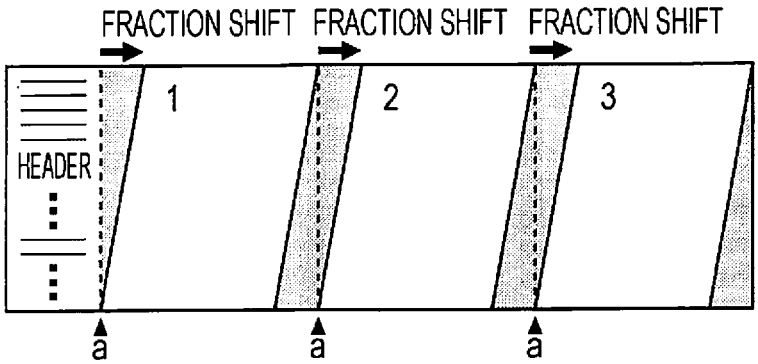

FIG. 16B illustrates an example in which the image data of the first page, the second page, and the third page is subjected to an inclination process (the primary transformation process). As illustrated in FIG. 16B, the image data which is subjected to the primary transformation process and stored in the third region has a structure such as the following. Specifically, the image data of the pages which are subjected to the primary transformation process as described above is of a structure in which the first page, the second page, and the third page are arranged in order of the page number from the left in FIG. 16B, and a header is attached to the leading portion of the first page. Page division information in each line, that is, information (intermediate data) of a point indicating a page delimiter in each line is described in the header. In FIG. 16B, a mark a illustrates a page delimiter.

Figure 17C:
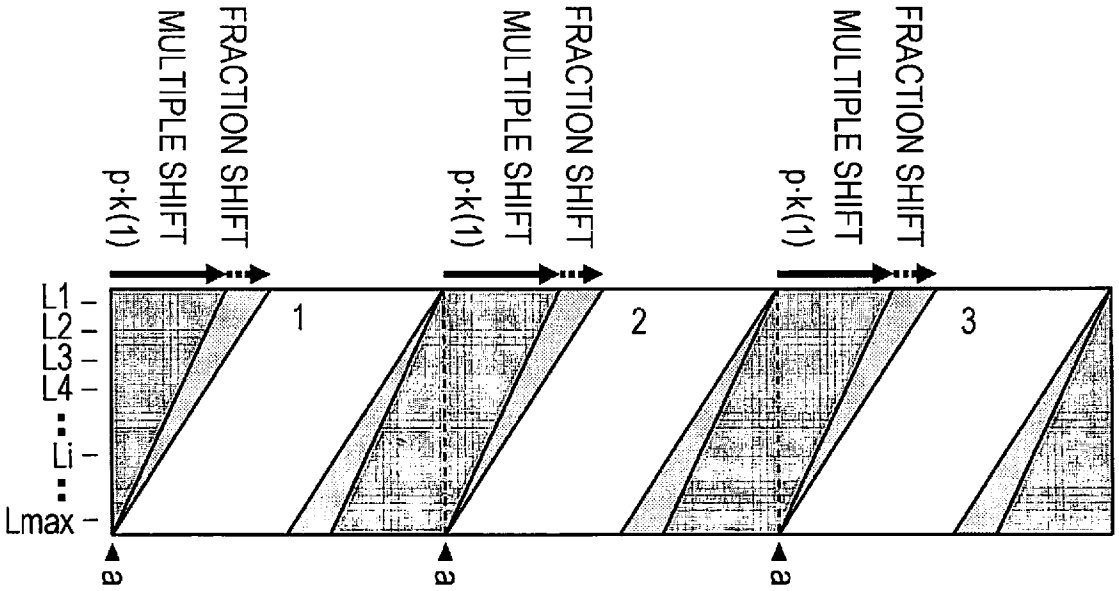
FIGS. 17C and 17D are diagrams for illustrating the processing of a plurality of pages.

When the secondary transformation process is carried out as illustrated in FIG. 17C, the lines are shifted (multiple shifted) in the line direction by a predetermined multiple for each line. At this time, the mark a also moves with the multiple shift.

Figure 17D:
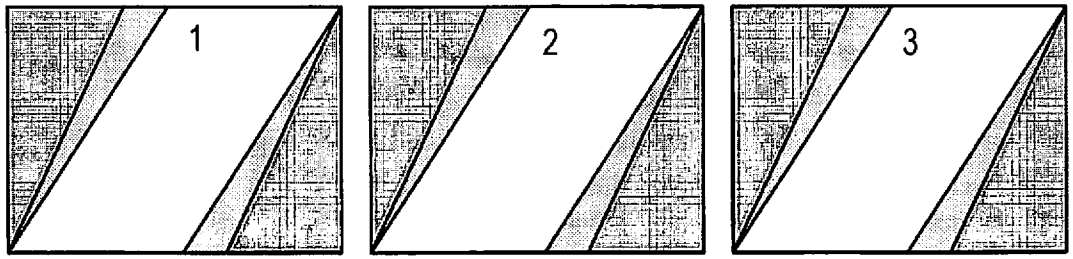

As illustrated in FIG. 17D, the image data which is subjected to the secondary transformation process is stored in the fourth region in a state of being divided into each page by the points indicated by the marks a. Note that, since the header is not necessary after the multiple shift and the rotation, the header is removed and is not stored in the fourth region.

The maximum shift amount in the secondary transformation process occurs at the first line in this example. The shift amount is a value obtained by multiplying the p bits which is the data width of the SRAM 112 by k(1). Here, k(1) is the quotient from when the substitution i=1 is carried out on the function k(i), that is, the total shift amount of the first line is divided by p.

As illustrated in FIG. 17D, after the image data in which the first page to the third page are batch processed is divided into each page and stored in the fourth region, and is supplied to the interface 205 in the liquid ejecting head 30 side as the print data SI using burst transfer.

According to the configuration, since the processes such as the shifting and the rotation are executed in a batch on the plurality of page of image data, the overheads are reduced. Therefore, it is possible to reduce the load of the process.

Note that, in the embodiment, to facilitate description, in relation to the array transformation process and the interpolation process, the print data SI is described as one bit;

however, for multi-gradation, the print data SI may be two bits or more. For example, assuming that the print data SI is two bits, when four grades are expressed as illustrated in FIG. 9, the two bits may be separated into a high-order bit and a low-order bit, each of the bits may be subjected to a similar array transformation process and an interpolation process, and the high-order bit and the low-order bit may be supplied to the liquid ejecting head 30 before the unit period Ta in which the ink is caused to be ejected.

In the embodiment, a configuration is adopted in which the print medium P is caused to move in the Y direction in relation to the liquid ejecting head 30 which includes the plurality of nozzles N; however, in contrast, a configuration may be adopted in which the liquid ejecting head 30 is caused to move in relation to the print medium P.

What is claimed is:

1. A printing apparatus which causes a print medium to move in a predetermined direction relative to a print head which includes a plurality of nozzles, and causes ink to be ejected from each of the plurality of nozzles based on print data, the printing apparatus comprising:

a first processing unit which stores image data of each pixel in memory, the memory being capable of burst transfer;

a second processing unit which performs an interpolation process on the image data stored by the first processing unit, the interpolation process being performed corresponding to a faulty nozzle of the print head; and a third processing unit which rotates the image data on which the interpolation process has been performed and stores the image data which corresponds to each of the plurality of nozzles in the memory such that the image data that has been rotated is in a read-out order of the memory when the print head is positioned at a certain point in relation to the print medium, the printing apparatus reading out the image data which is stored by the third processing unit and outputs the image data as the print data, the first processing unit and the third processing unit storing the image data using the burst transfer, and the second processing unit executing the interpolation process using the image data which is read out from the memory using the burst transfer, wherein the second processing unit executes the interpolation process using at least the image data of two rows which interpose a column corresponding to a position of the faulty nozzle.

2. The printing apparatus according to claim 1, wherein information defining at least the faulty nozzle is supplied to the second processing unit.

3. A control device which controls a printing apparatus which causes a print medium to move in a predetermined direction relative to a print head which includes a plurality of nozzles, and causes ink to be ejected from each of the plurality of nozzles based on print data, the control device comprising:

a first processing unit which stores image data which defines an ink amount to be ejected from each of the plurality of nozzles in memory, the memory being capable of burst transfer;

a second processing unit which performs an interpolation process on the image data stored by the first processing unit, the interpolation process being performed corresponding to a faulty nozzle of the print head; and a third processing unit which rotates the image data on which the interpolation process has been performed and stores the image data which defines the ink amount to be ejected and corresponds to each of the plurality of nozzles in the memory such that the image data that has been rotated is in a read-out order of the memory when the print head is positioned at a certain point in relation to the print medium, the control device reading out the image data which is stored by the third processing unit and outputs the image data as the print data, the first processing unit and the third processing unit storing the image data using the burst transfer, and the second processing unit executing the interpolation process using the image data which is read out from the memory using the burst transfer, wherein the second processing unit executes the interpolation process using at least the image data of two rows which interpose a column corresponding to a position of the faulty nozzle.

4. An image processing method of a printing apparatus which causes a print medium to move in a predetermined direction relative to a print head which includes a plurality of nozzles, and causes ink to be ejected from each of the plurality of nozzles based on print data, the method comprising:

storing image data which defines an ink amount to be ejected from each of the plurality of nozzles in memory, the memory being capable of burst transfer, the storing of the image data including storing the image data using the burst transfer;

performing an interpolation process on the image data in the memory, the interpolation process being performed corresponding to a faulty nozzle of the print head, the performing of the interpolation process including executing the interpolation process using the image data which is read out from the memory using the burst transfer;

rotating the image data on which the interpolation process has been performed and storing, using the burst transfer, the image data which defines the ink amount to be ejected and corresponds to each of the plurality of nozzles in the memory such that the image data that has been rotated is in a read-out order of the memory when the print head is positioned at a certain point in relation to the print medium; and reading out the image data which is subjected to the rotation process and outputting the image data as the print data, wherein the interpolation process uses at least the image data of two rows which interpose a column corresponding to a position of the faulty nozzle.

* * * * *